US009593495B2

(12) United States Patent
Golovatskiy

(10) Patent No.: US 9,593,495 B2
(45) Date of Patent: Mar. 14, 2017

(54) TUCK-POINTING TOOL FOR APPLYING MORTAR

(71) Applicant: Daniil M. Golovatskiy, Ballwin, MO (US)

(72) Inventor: Daniil M. Golovatskiy, Ballwin, MO (US)

( * ) Notice: Subject to any disclaimer, the term of this patent is extended or adjusted under 35 U.S.C. 154(b) by 0 days.

(21) Appl. No.: 14/940,965

(22) Filed: Nov. 13, 2015

(65) Prior Publication Data

US 2016/0138278 A1 May 19, 2016

Related U.S. Application Data

(60) Provisional application No. 62/079,860, filed on Nov. 14, 2014.

(51) Int. Cl.

| | |
|---|---|
| ***E04B 1/00*** | (2006.01) |
| ***E04F 21/165*** | (2006.01) |
| ***E04G 23/02*** | (2006.01) |
| ***E04G 21/20*** | (2006.01) |

(52) U.S. Cl.
CPC ..... *E04F 21/165* (2013.01); *E04G 21/20* (2013.01); *E04G 23/0296* (2013.01)

(58) Field of Classification Search
CPC ..... E04F 21/165; E04G 23/0296
USPC ... 52/741.1, 749.13, 741.13, 742.13, 742.14; 15/235.4
See application file for complete search history.

(56) References Cited

U.S. PATENT DOCUMENTS 1,321,532 A * 11/1919 Mann ..... E04F 21/161 15/235.6
2,618,501 A * 11/1952 Tallant ..... A01B 1/02 37/434
2,623,523 A * 12/1952 Benson ..... A61M 31/00 128/858
3,079,622 A * 3/1963 Smyers ..... E04F 21/1655 15/235.7
3,108,313 A 10/1963 Summers
3,162,886 A 12/1964 Wise
3,608,944 A * 9/1971 Turner ..... E04G 21/20 15/235.3
3,768,939 A 10/1973 Gramling
3,804,450 A * 4/1974 Guenzel ..... A01B 1/20 294/180
4,043,487 A 8/1977 Price
4,241,470 A * 12/1980 Herzig ..... E04G 21/20 15/235.4
4,311,258 A 1/1982 Bradshaw
4,669,970 A * 6/1987 Perry ..... E04F 21/1655 15/235.7

(Continued)

FOREIGN PATENT DOCUMENTS

DE 3443941 A1 * 6/1986 ..... E04F 21/165

*Primary Examiner* — Basil Katcheves
(74) *Attorney, Agent, or Firm* — Nixon Peabody LLP

(57) ABSTRACT

The present invention is a mortar tool for creating a vertical mortar joint. The mortar tool comprises a first sidewall having a first lowermost portion, and a second sidewall having a second lowermost portion that is connected to the first lowermost portion of the first sidewall. The first and second sidewalls are at an angle relative to each other and define a channel therebetween. The channel is for receiving mortar that can be transferred to a vertical gap between adjacent bricks or stones from an opening defined by the ends of the first and second sidewalls.

18 Claims, 4 Drawing Sheets

(56) References Cited

U.S. PATENT DOCUMENTS 4,848,818 A * 7/1989 Smith ..... E04D 13/0765 15/236.04
4,915,610 A * 4/1990 Curry ..... E04F 21/165 15/235.3
4,946,360 A * 8/1990 Brown ..... B05C 17/10 15/235.7
5,046,642 A 9/1991 Cathcart, Sr.
5,067,889 A * 11/1991 Humiston ..... E04F 21/1655 15/235.7
5,098,278 A * 3/1992 Brandvold ..... B28B 7/0085 15/235.3
5,104,013 A * 4/1992 Hawley ..... B65D 35/38 222/566
D333,600 S * 3/1993 Brandvold ..... D8/45
5,314,100 A 5/1994 Deaver
5,385,274 A * 1/1995 Twyman ..... B05C 17/01 106/713
5,442,832 A * 8/1995 Tonsager ..... E04F 21/1655 15/235.7
5,664,280 A * 9/1997 Tonsager ..... E04F 21/1655 15/235.7
5,791,708 A * 8/1998 Capriotti ..... E02F 3/02 172/377
5,792,489 A * 8/1998 Liberman ..... E04F 21/1655 15/235.7
6,227,813 B1 5/2001 Leimer
6,880,198 B1 * 4/2005 Hazard ..... E04F 21/165 15/235.4
7,047,588 B2 5/2006 Bennett
D606,375 S * 12/2009 Divita ..... D8/45
7,748,920 B2 7/2010 Murray
7,972,074 B2 * 7/2011 Lepage ..... E04F 21/165 15/235.7
2011/0041277 A1 * 2/2011 Giannantonio ..... E04F 21/161 15/235.7
2015/0354236 A1 * 12/2015 Andrews ..... E04F 21/165 15/235.4

* cited by examiner

TUCK-POINTING TOOL FOR APPLYING MORTAR

CROSS-REFERENCE TO RELATED APPLICATIONS

This application claims the benefit of U.S. Provisional Application No. 62/079,860, filed Nov. 14, 2014, which is hereby incorporated by reference herein in its entirety.

FIELD OF THE INVENTION

The present invention relates generally to masonry. Specifically, it relates to a tuck-pointing tool that assists with the insertion of mortar between adjacent bricks or stones.

BACKGROUND OF THE INVENTION

Tuck-pointing is a process that involves the replacement of mortar that is positioned between bricks or stones. Stones and bricks have a long lifespan compared to the mortar that is located at the joints between adjacent stones and bricks. The mortar is typically damaged due to the natural weather exposure over a period of time.

The tuck-pointing process involves removing the exposed portion of the damaged mortar (e.g., removal of about 1 inch of old mortar from the gaps between the bricks), usually with a power grinding tool that fits between the adjacent bricks or stones. Once the damaged mortar has been removed, new mortar is manually placed between the adjacent bricks or stones with a tool that forces the mortar into those gaps to create a joint. The tools typically include various sizes of knives that are dimensioned to fit within the gaps. They also include shapes to allow for a smooth curvature for the mortar joint.

One problem associated with tuck pointing is the placement of the new mortar in the vertical gaps between adjacent side-by-side bricks. Because bricks are stacked in layers, the horizontal gaps are continuous and can be easily filled with mortar to create long, continuous mortar joints between adjacent rows of bricks. However, because the vertical gaps are staggered, there is only a small length to each vertical gap. In the normal course of operation, the operator picks up a portion of the mortar with a mortar knife and forces it into the vertical gap. But, it is often difficult to gather enough mortar on the knife to permit adequate filling of the vertical gap, thereby requiring multiple iterations of placement of the mortar into the vertical gap by the knife to completely create the vertical mortar joint.

To address this problem, one tool that has been developed is a mortar or grout bag, which is similar in functionality to a pastry bag. The mortar bag is filled with mortar and the operator manually squeezes the bag to force the mortar out of the tip and into the vertical gap and create the joint. However, because of the high density of the mortar, it often takes a large amount of manual force to force the mortar from the tip. Considering that hundreds of vertical gaps require a new mortar joint on a typical wall, the operator's arms can become fatigued from the repeated squeezing and clinching associated with the operation of the mortar bag. Furthermore, because the force behind the mortar as it exits the mortar bag is less than the manual force from a typical knife that pushes the mortar between a horizontal gap, the operator often needs to go back over the freshly applied mortar in the vertical gap with a knife to finish the vertical mortar joint.

Accordingly, there is a need for an improved tuck-pointing tool that can assist the operator with inserting mortar into the vertical gaps between adjacent bricks and stones.

SUMMARY OF THE INVENTION

In one aspect, the present invention is a mortar tool for creating a vertical mortar joint. The mortar tool comprises a first sidewall having a first lowermost portion, and a second sidewall having a second lowermost portion that is connected to the first lowermost portion of the first sidewall. The first and second sidewalls are at an angle relative to each other and define a channel therebetween. The channel is for receiving mortar that can be transferred to the vertical gap between adjacent bricks or stones from an opening defined by the ends of the first and second sidewalls.

In another aspect, the present invention also involves a method for creating a vertical mortar joint between adjacent bricks or stones, comprising (i) filling a mortar channel with mortar, (ii) placing the mortar channel with the mortar against a vertical gap between the adjacent bricks, and (iii) using a tool shaped to fit within the mortar channel to force the mortar into the vertical gap. The vertical mortar joint is comprised of the mortar that has exited the opening in the mortar channel.

Additional aspects of the invention will be apparent to those of ordinary skill in the art in view of the detailed description of various embodiments, which is made with reference to the drawings, a brief description of which is provided below.

Figure 1:
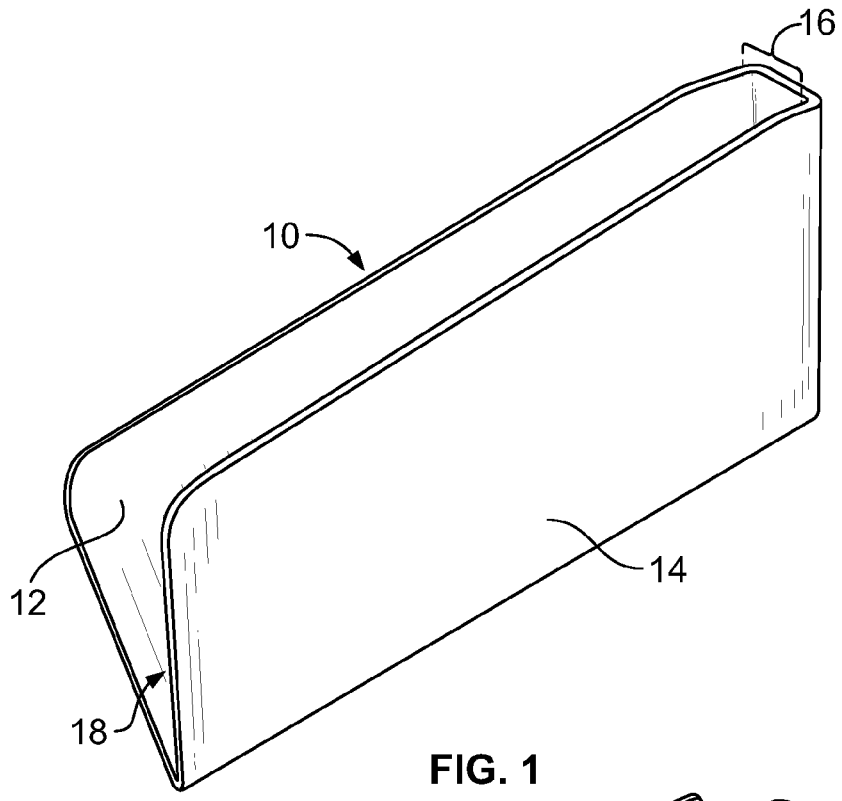
FIG. 1 illustrates a mortar channel according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, a mortar channel 10 includes a first sidewall 12 and a second sidewall 14. The sidewalls 12 and 14 are attached to each other by a back wall 16 and define a channel therebetween. An opening 18 is positioned between the sidewalls 12 and 14 at a location that is opposite of the back wall 16. The opening 18 is defined by the ends of the first and second sidewalls 12 and 14. The mortar channel 10 has a generally V-shaped configuration as the bottom portions of first and second sidewalls 12 and 14 meet at a sharp bend. Alternatively, the mortar channel 10 can have a U-shaped cross-sectional configuration such that the lowermost bend is gradual and rounded.

The mortar channel 10 is preferably made of a flexible material that allows the shape of the opening 18 to be slightly adjusted by application of a manual force from the hand of the operator as he or she holds the sidewalls 12 and 14. In one embodiment, the mortar channel 10 is made from a sheet-metal material, such as aluminum sheet metal. As an example, the mortar channel 10 can be formed by aluminum sheet metal having a thickness in the range from about 0.02 inches to about 0.05 inches. When such a thickness is used, the sidewalls 12 and 14 provide some level of flexibility under the manual force of the operator, while returning to their original positions in response to the manual force being released (i.e., elastic deformation around the connected bottom portions of the sidewalls 12 and 14). The flexibility allows the sidewalls 12 and 14 to be positioned so as to generally match the width of the vertical gap. In another embodiment, the mortar channel 10 can be made of various plastic materials (preferably flexible) through a molding process. In such an embodiment, the mortar channel 10 can be disposed of after daily use, or it could be washed and reused again.

The height of the mortar channel 10 is typically in the range from about 2 inches to about 5 inches, depending on the application. For example, when used with typical brick, the height of the mortar channel 10 is preferably about 3 inches so as to completely cover the length of the vertical gap between adjacent bricks that is to receive the mortar. The width of the opening 18 at the upper portion of the mortar channel 10 is typically about 1 inch, while the width of the opening 18 at the lower portion of the mortar channel 10 (adjacent to the bend) is typically about ⅛ inches to about a ¼ inches. The angle between the first and second sidewalls 12 and 14 is generally in the range from about 10° to about 30°. The mortar channel 10 may also include of a flat, U-shaped bottom bend between the first and second sidewalls 12 and 14. In any case, the averages dimensions between the first and second sidewalls 12 and 14 are approximately the same as the width of the vertical gaps between adjacent bricks.

Figure 2:
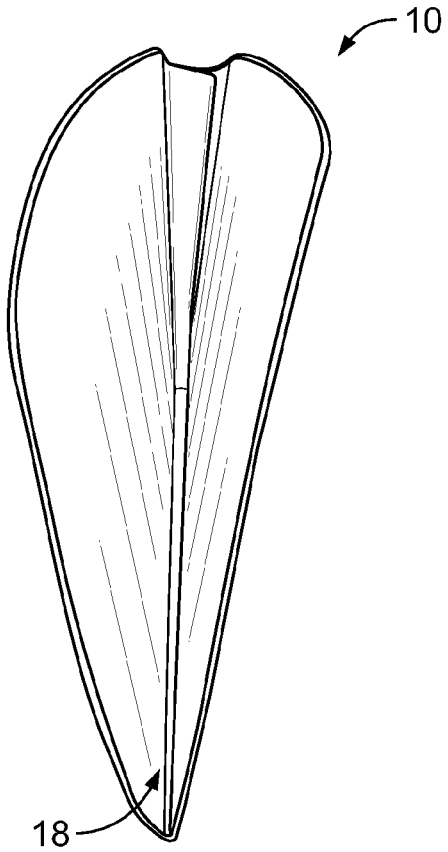
FIG. 2 is an end view of the mortar channel.

FIG. 2 illustrates the mortar channel 10 from the opening 18. In use, the mortar will be pushed from the mortar channel 10 towards the opening 18 and into a vertical gap between adjacent bricks.

Figure 3:
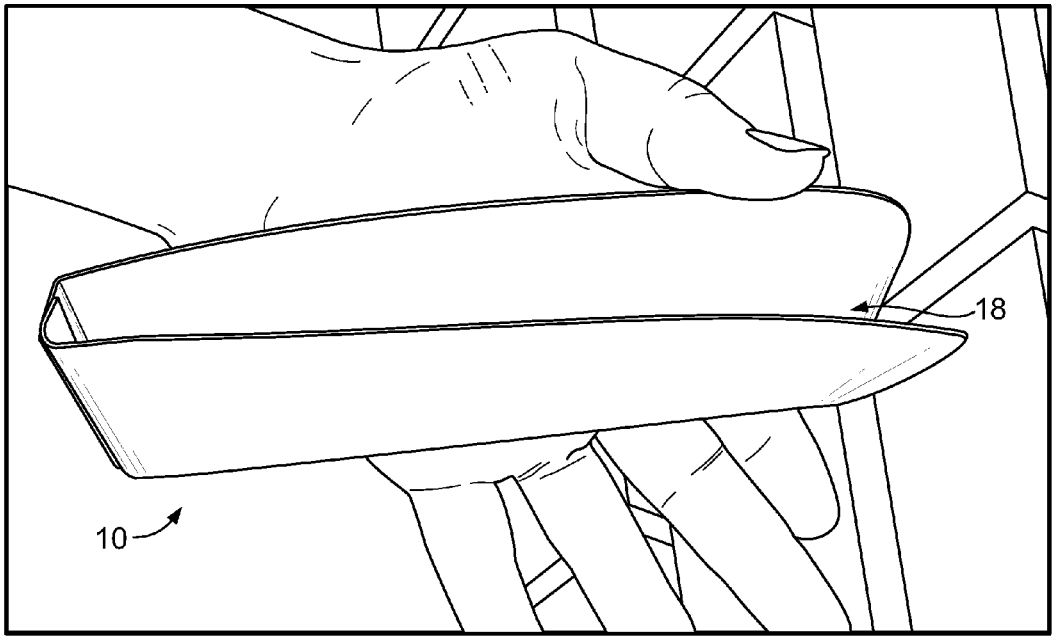
FIG. 3 is a side view of the mortar channel being placed adjacent to a vertical gap in bricks to create a vertical mortar joint.
Figure 4:
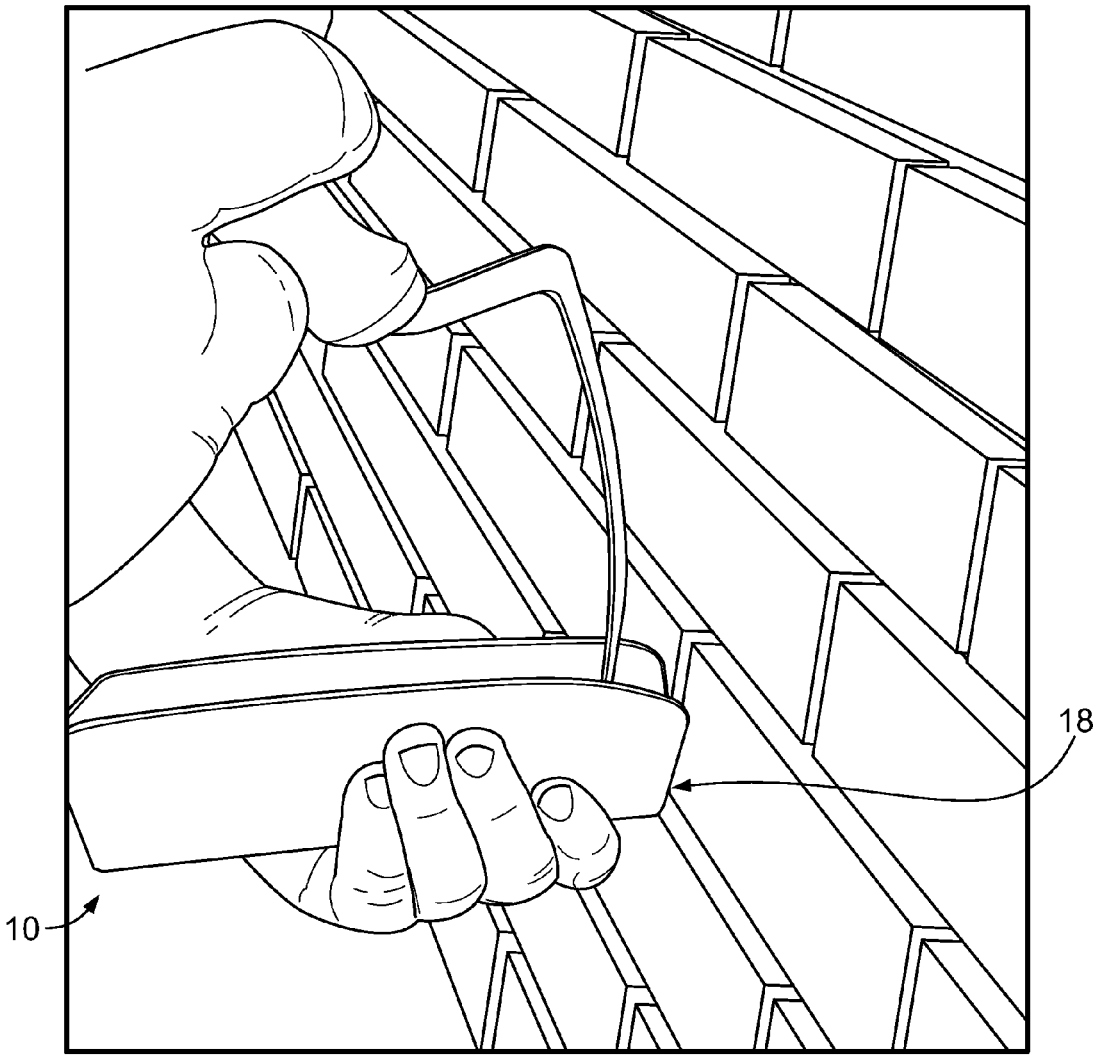
FIG. 4 is a side view of a knife within the mortar channel of FIG. 3 that forces the mortar into the vertical gap between two bricks to create the vertical mortar joint.

FIGS. 3-4 illustrate the use of the mortar channel 10. Initially, the mortar channel 10 is placed into a container of mortar and the operator scoops mortar into the mortar channel 10. With the mortar channel 10 now filled with some amount of mortar, the operator places the mortar channel 10 against the bricks defining the vertical gap that requires mortar, as shown in FIG. 3. Next, the operator takes a common tuck-pointing tool, such as a knife (which itself has a generally V-shaped profile on its exterior), and forces the mortar to exit the opening 18 of the mortar channel 10 and enter the vertical gap. Because the operator is placing manual force on the mortar as the mortar enters the vertical gap, the mortar is compressed deeply into the vertical gap. This process provides for a structurally sound vertical mortar joint.

Figure 5:
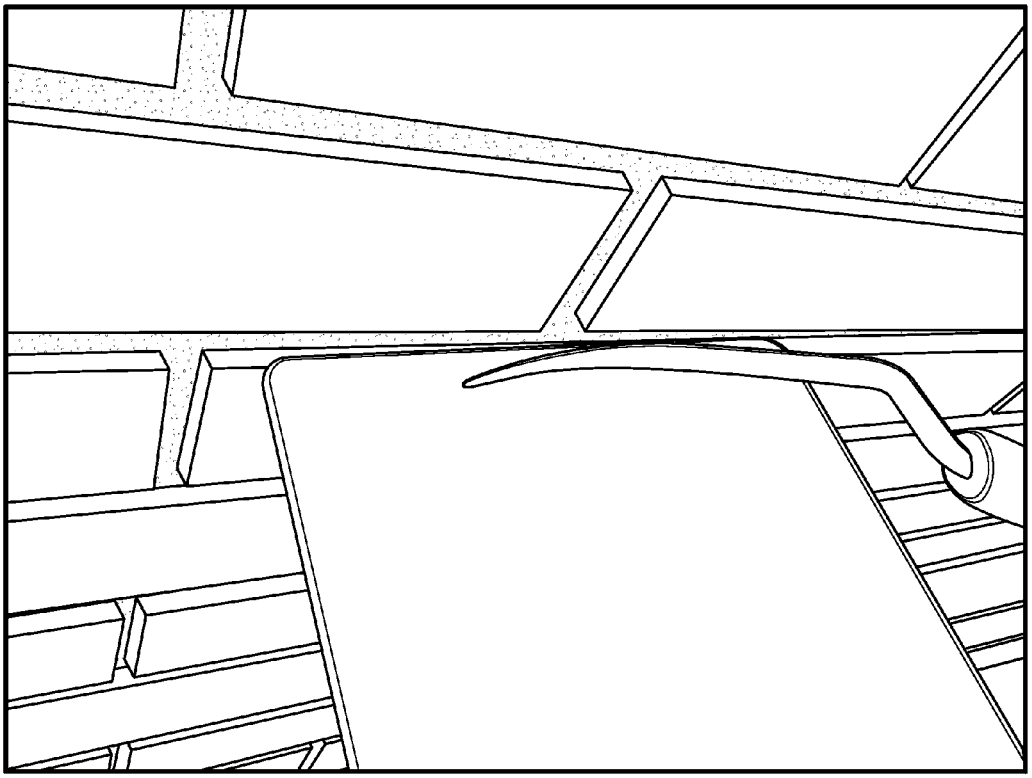
FIG. 5 is a horizontal platform on which mortar is placed and the same knife as in FIG. 4 that forces mortar into the horizontal gaps to develop the horizontal mortar joint.

FIG. 5 illustrates a typical hawk plate that is held by the operator through a bottom post-like handle (not shown) for the purpose of placing mortar in a horizontal orientation such that it can be easily placed within a horizontal gap. As can be seen in FIG. 5, the knife tool that is used to fill the horizontal gaps to create the horizontal mortar joint is the same tool that is used in FIG. 4 to force the mortar from the opening 18 of the mortar channel 10 and into the vertical gap to create a vertical mortar joint. In other words, creation of the horizontal mortar joint occurs through the use of the same tool that creates the vertical mortar joint when it is used in combination with the mortar channel 10.

The present invention also contemplates kits of mortar channels 10. The kit includes multiple sizes of mortar channels 10 to meet the requirements of different sized gaps in stone and/or brick. Furthermore, the present invention contemplates the kits having multiple disposable mortar channels 10 (e.g., each comprised of a polymeric material). The present invention also contemplates a kit of one or more mortar channels 10 and a knife-like tool that has an external profile that substantially matches the internal profile of the V-shaped or U-shaped configuration of the mortar channel 10.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A method of creating a vertical mortar joint between adjacent bricks, comprising:

filling a mortar channel of a mortar tool with mortar, the mortar tool having a first sidewall and a second sidewall that define the mortar channel in which the mortar is filled, the first sidewall and a second sidewall being initially positioned at a first angle relative to each other;

placing the mortar channel with the mortar directly adjacent to a vertical gap having a width between the adjacent bricks;

while the mortar is in the mortar channel, applying a manual force to the first sidewall and the second sidewall to adjust the first angle to a second angle between the first sidewall and the second sidewall to better to match the width of the vertical gap between the adjacent bricks; and using a tool shaped to fit within the mortar channel to discharge the mortar from the mortar tool and into the vertical gap, the discharged mortar defining the vertical mortar joint.

2. The method of claim 1, wherein applying the force to the first sidewall and the second sidewall causes the first sidewall and the second sidewall to bend towards each other to create the second angle to more accurately match the width of the vertical gap.

3. The method of claim 2, wherein the first sidewall and the second sidewall define an opening that is adjacent to the vertical gap, and wherein the first sidewall and the second sidewall are adjusted to the second angle such that a width of an upper portion of the opening is about 1 inch.

4. The method of claim 1, wherein the mortar channel has an internal profile that substantially matches an external profile of the tool such that the tool is capable of fitting within a bottom portion of the mortar channel.

5. The method of claim 4, wherein the mortar channel has an internal profile that is V-shaped and the tool has an external profile that is V-shaped.

6. The method of claim 4, wherein the mortar channel has an internal profile that is U-shaped and the tool has an external profile that is U-shaped.

7. The method of claim 1, wherein the first sidewall and the second sidewall are made from a single piece of material, and wherein the first sidewall and the second sidewall are connected at a U-shaped bend in the single piece of material.

8. The method of claim 7, wherein the first sidewall and the second sidewall are continuously connected at the U-shaped bend in the piece of material along substantially an entire length of the mortar tool.

9. The method of claim 1, wherein a back wall connects the first sidewall and the second sidewall along substantially an entire height of the mortar tool.

10. The method of claim 1, wherein the mortar tool has a continuous lowermost surface below the U-shaped bend such that the mortar tool lacks any structure protruding downwardly away from the mortar tool that would impede the manual grasping of the first and second sidewalls by the operator's hand as the manual force is being placed on the first and second sidewalls.

11. The method of claim 1, wherein the first angle or the second angle between the first sidewall and the second sidewall is in a range from about 10° to about 30°.

12. A mortar tool for creating a vertical mortar joint in vertical gap between adjacent bricks, comprising:

a first sidewall having a first lowermost portion;

a second sidewall having a second lowermost portion, the first sidewall and the second sidewall being at an angle relative to each other and being made from a single piece of material, the first lowermost portion and the second lowermost portion being connected at a U-shaped bend within the piece of material; and a back wall connecting the first sidewall and the second sidewall along substantially an entire height of the mortar tool, the first sidewall and the second sidewall defining a channel therebetween, the channel having an opening defined by an end of the first sidewall and an end of the second sidewall, the opening being on an opposite side of the tool relative to the back wall, the first lowermost portion and the second lowermost portion being connected at the U-shaped bend substantially along an entire length of the mortar tool between the back wall and the opening;

wherein (i) the thickness of the material is in a range from about 0.02 inches to about 0.05 inches, (ii) the angle between the first sidewall and the second sidewall initially being in a range from about 10° to about 30° and being adjustable to a second angle in response to a manual force being placed on the first sidewall and the second sidewall to thereby match a width of the vertical gap between the adjacent bricks, (iii) a height of the channel is about 3 inches, (iv) a width of an upper portion of the opening is about 1 inch, and (v) a width of a lower portion of the opening is in a range from about ⅛ inches to about ¼ inches.

13. The mortar tool of claim 12, wherein the material is a sheet metal.

14. The mortar tool of claim 13, wherein the sheet metal is aluminum.

15. The mortar tool of claim 12, wherein the material is a polymer.

16. The mortar tool of claim 12, in combination with a knife that has a shape configured to fit between the first and second sidewalls and force the mortar through the opening.

17. The mortar tool of claim 16, wherein the shape of the knife substantially matches a shape of a region defined between the first and second sidewalls.

18. The mortar tool of claim 12, wherein the mortar tool has a continuous lowermost surface below the U-shaped bend such that the mortar tool lacks any structure protruding downwardly away from the mortar tool that would impede the manual grasping of the first and second sidewalls by the operator's hand as the manual force is being placed on the first and second sidewalls.

* * * * *